United States Patent [19]

Ohara et al.

[11] Patent Number: 4,841,583

[45] Date of Patent: Jun. 27, 1989

[54] CAPACITANCE TOILET SEAT SWITCH FOR BIDET

[75] Inventors: Mitsuhiro Ohara, Toyoake; Kenichi Kaneko, Kariya, both of Japan

[73] Assignee: Aisin Seiki Kabushiki Kaisha, Japan

[21] Appl. No.: 90,472

[22] Filed: Aug. 28, 1987

[30] Foreign Application Priority Data

Aug. 29, 1986 [JP] Japan ..... 61-133562

[51] Int. Cl.[4] ..... A47K 3/22

[52] U.S. Cl. ..... 4/420.4; 4/447; 4/448; 4/DIG. 6

[58] Field of Search ..... 4/420.1–420.5, 4/447, 448, 238, 250, 251, DIG. 6, 305, 313, 623, 443, DIG. 3, 406; 200/DIG. 1

[56] References Cited

U.S. PATENT DOCUMENTS

| | | | |
|---|---|---|---|
| 3,551,919 | 1/1971 | Forbes | 4/623 |
| 3,575,640 | 4/1971 | Ishikawa | 4/313 |
| 4,087,868 | 5/1978 | Gentz | 4/447 |
| 4,500,758 | 2/1985 | Guckenheimer | 200/DIG. 1 |
| 4,550,310 | 10/1985 | Yamaguchi et al. | 200/DIG. 1 |
| 4,562,315 | 12/1985 | Avfderheide | 200/DIG. 1 |
| 4,616,368 | 10/1986 | Nagai et al. | 4/420.4 |

FOREIGN PATENT DOCUMENTS

| | | | |
|---|---|---|---|
| 1944165 | 3/1971 | Fed. Rep. of Germany | 4/406 |
| 838243 | 6/1960 | United Kingdom | 4/DIG. 6 |

*Primary Examiner*—Stephen Marcus

*Attorney, Agent, or Firm*—Sughrue, Mion, Zinn, Macpeak & Seas

[57] ABSTRACT

A sanitary device includes a electrically operated washing device, an operating switch, a protecting switch and a power supply connected in series to define an operating circuit. The protecting switch is under the control of a control device for detecting a variation in capacitance between two opposed electric conductors, both of which are provided in a toilet seat. Upon detection of a predetermined increase in capacitance between the conductors after a person sits down on the seat, the protecting switch is brought into closure by the control device. Thus, in spite of an unexpected closure of the operating switch due to accidental contact or mischief of a child while no person is on the seat, the washing device will not be actuated.

3 Claims, 3 Drawing Sheets

CAPACITANCE TOILET SEAT SWITCH FOR BIDET

BACKGROUND OF THE INVENTION

1. Field of the Invention

The present invention relates to a sanitary device for a toilet and in particular to a sanitary device which may not be operated when a user is not on the toilet seat.

2. Prior Art

As is well known, a sanitary device for a toilet includes an electrically operated washing device having nozzle means for washing the anus portion of a person who is on the toilet seat. After the nozzle means is moved or extended into the toilet bowl by an electrical driving means upon closure of an operating switch which is interposed between the driving device and a power supply, water is sprayed from the nozzle means towards the anus of the person for washing. In order to prevent unexpected closure of the operating switch while no person is on the seat due to accidental contact or mischief of a child, a protecting switch is connected in series with the operating switch. A conventional protecting switch is operatively connected to the seat and is brought into closure due to the load or weight of the person sitting on the seat, as disclosed in Japanese Utility Model Registration Laid Open Print No. 56(1981)-171800.

However, the protecting switch is sometimes not closed due to an offset load on the seat as a result of an incorrect position of the person thereon.

SUMMARY OF THE INVENTION

It is, therefore, an object of the present invention to provide a sanitary device for a toilet in which a protecting switch may be closed regardless of load distribution on the seat when a person sits down on a seat regardless of the person's position on the seat.

According to the present invention, a pair of opposed electric conductors are disposed in a seat and are connected to a control means under which a protecting switch is set. The conductors act as a capacitor so that the control circuit detects whether a person is on the seat or not, by monitoring variations in capacity between the conductors. Thus, the control means may close the protecting switch upon detection of a predetermined increase in capacitance between the conductors after the person sits down on the seat so that an electrically operated washing device is ready for operation upon subsequent closure of an operating switch.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
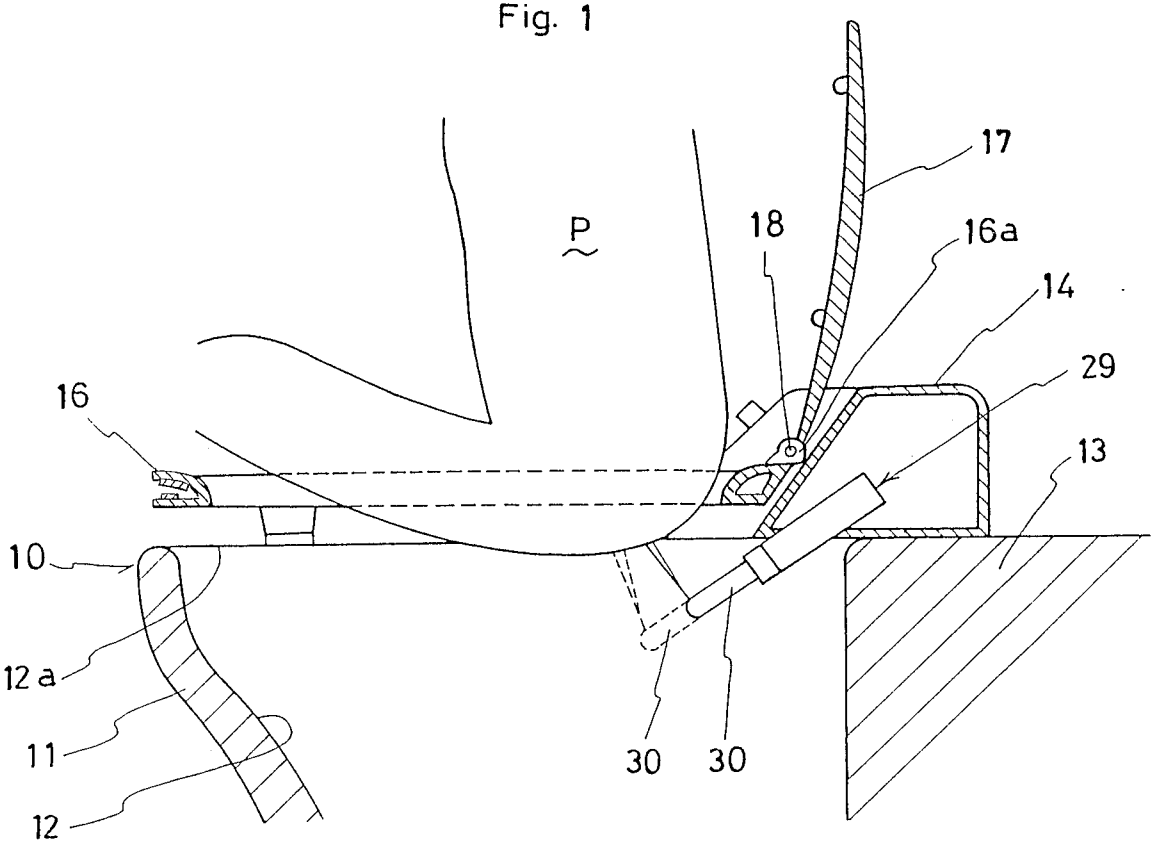
FIG. 1 is a side view of a sanitary device in accordance with the present invention.
Figure 2:
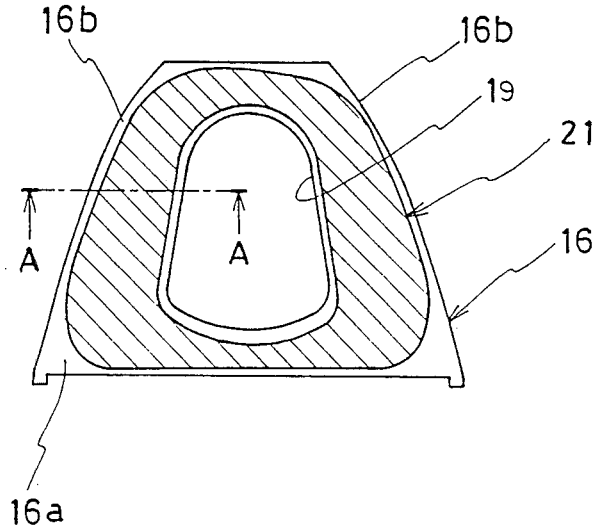
FIG. 2 is a bottom view of a seat of the sanitary device in FIG. 1.
Figure 3:
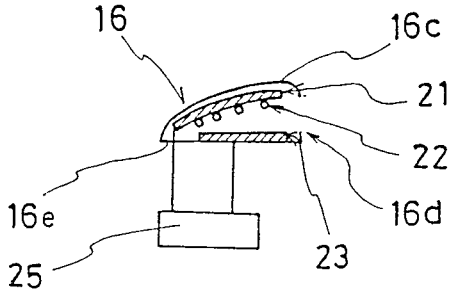
FIG. 3 is a cross-sectional view taken along line A—A in FIG. 2.
Figure 4:
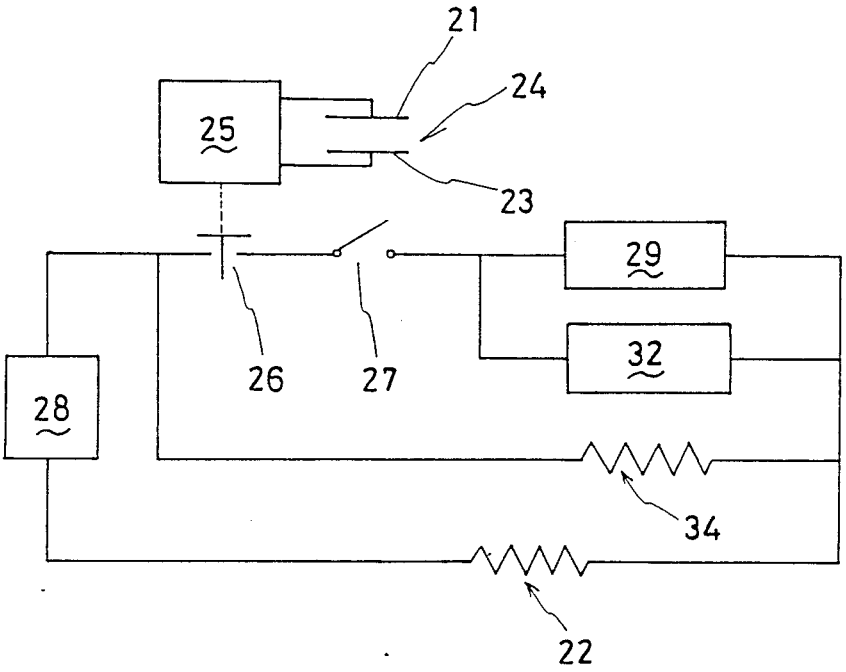
FIG. 4 is an electric control circuit for the sanitary device in FIG. 1.
Figure 5:
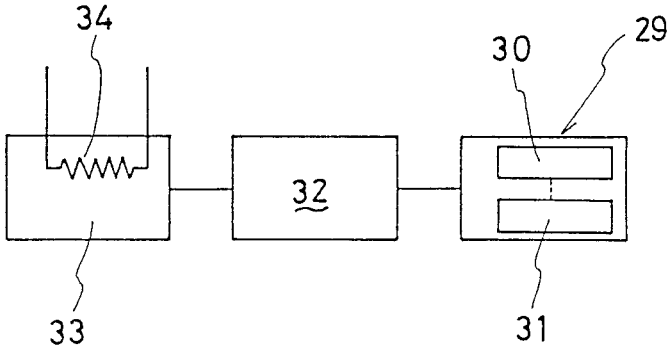
FIG. 5 is a block diagram of a water circuit for the sanitary device in FIG. 1.

Referring now to FIGS. 1 through 5, the sanitary device 10 includes a toilet bowl 11. The toilet bowl 11 has a bowl shaped water containing section 12, a rim portion 12*a* surrounding an opening for the section 12, and a flat portion 13 which is extended from the rim portion 12*a* in the rearward direction. A casing 14 is fixedly mounted to the flat portion 13. A seat 16 and a lid 17, each of which is of conventional or well-known construction, are hingedly connected to the casing 14 by common pins 18 (only one is shown) to be raised or lowered. The seat 16 includes a rear end protion 16*a* which is hinged to the casing 14 and a pair of forward extensions 16*b*,16*b*, between which an opening 19 is defined. Though each distal end portion of the extensions 16*b*, 16*b* are connected with each other, a clearance (not shown) may be defined between the distal end portions of the extensions 16*b*, 16*b* as is well-known. Each extension 16*b* has a curved upper portion 16*c*, a flat bottom member 16*e*, and an opening 16*d* therebetween.

A first electric conductor 21, which is in the form of a thin aluminum plate, is adhesively secured on the under surface of the curved upper portion 16*c* of the seat 16, and a heater wire 22 is adhesively secured on the first electric conductor 21 so as to warm the curved upper portion 16*c* of the seat 16 evenly by uniformly distributing the heat through the conductor 21. A second electric conductor 23 in the form of a thin aluminum plate, is adhesively secured on the bottom 16*e* so as to be opposed to the first electric conductor 21. Thus, both conductors 21 and 23 constitute a capacitor 24. Since the forwardly extending portions of the seat are of a substantially hollow construction, it is inherent in the construction that the upper portion 16*c* will be pressed downwardly toward the lower portion 16*e* when a person is seated on the toilet seat. This the upper conductor 21 will be moved closer to the lower conductor 23, thereby causing a change in the capacitance which will be detected by the microcomputer 25 to provide a control signal for operating the switch 26. The capacity between both conductors 21 and 23 of the capacitor 24 will be increased when a person P is seated on the seat 16, and such variation in capacity is detected by a control means 25 in the form of a microcomputer. A protecting switch 26, which is connected to an operating switch 27 in series, is under the control of the control means 25 and is brought into closure by order of the control means 25 when a person sits on the seat 16.

Although a heating element 22 is provided in contact with the aluminum sheet 21, it is immaterial whether the heating element is energized or deenergized with respect to the detection of the presence of a person on the toilet seat. Any change in the ambient temperature will be gradual, and although a slight change in the capacitance of the assembly might gradually occur, it would be obvious to one skilled in the art that the microcomputer 25 could be set to detect substantially instantaneous large changes in capacitance due to the present of a person sitting on the seat.

The non-illustrated clearance between the distal end portions of the extensions 16*b*, 16*b* does not have any effect on the operation of the capacitance operated switch since the clearance referred to is the spacing between the forward ends of the forwardly extending projections which define the toilet seat. It is well known in the art that toilet seats may be in the form of an oval or of a U-shaped configuration and the clearance or spacing between the arms of the U-shaped toilet seat to not have any function in the operation of the capacitance operated switch. Likewise, the opening in the toilet seat does not have any effect whatsoever on the operation of the capacitance switch.

In the casing 14, there is provided an electrically operated washing device 29 which is connected to a power supply 28 via the operating switch 27 and the protecting switch 26. When the operating switch 27 is closed when the protecting switch 26 is closed, a nozzle 30 of the washing device 29 is extended into the bowl 11 for spraying an amount of water at a warm temperature to the anus portion of the person P on the seat 16 and is returned to the original position upon completion of the washing. The nozzle 30 is driven by a motor 31 and is also under the control of the control means 25. A pump 32 is employed for supplying an amount of water under pressure to the nozzle 30 from a tank 33 in which water is stored and is warmed to a set temperature by a heater 34. The detailed construction of the washing device 29 is omitted due to the well-known construction thereof. It is noted that the nozzle 30 may be replaced by another nozzle which is extended by supplied water under pressure by the pump 32 or a swing type nozzle to which water under pressure is supplied by the pump 32.

While the invention has been particularly shown and described with reference to preferred embodiments thereof, it will be understood by those in the art that the foregoing and other changes in form and details may be made therein, without departing from the spirit and scope of the invention.

What is claimed is:

1. A sanitary device comprising:

a toilet bowl having a rear portion;

a casing fixedly mounted on said rear portion;

a seat including a rear end portion hingedly connected to said casing to be raised or lowered and a pair of spaced apart foward extensions, each of said extensions having an upper portion and a lower member with an opening therebetween;

an electrically operated washing device carried by said casing and having a nozzle from which an amount of water may be sprayed toward the anus portion of a person on said seat;

an operation switch;

a protecting switch connected to said operating switch in series;

a power supply connected to said electrically operated washing device via said operating switch and said protecting switch to thereby define an electric circuit;

a first electric conductor adhesively secured to an under side of said upper portion of said seat;

a second electric conductor adhesively secured on said lower member in spaced relation to said first electric conductor; and a control means connected to said conductors for detecting a variation in capacitance between said electric conductors to thereby close said protecting switch upon detection of a predetermined increase in capacitance between the conductors after a person sits down on said seat.

2. A sanitary device in accordance with claim 1, further comprising a heater adhesively secured on said first electric conductor for warming said upper portion of said seat at a predetermined temperature.

3. A sanitary device in accordance with claim 1 in which said first electric conductor and said second electric conductor are each in the form of a thin aluminum plate.

* * * * *